United States Patent [19]

Dvoracek

[11] 4,444,649

[45] Apr. 24, 1984

[54] ANTIFOULANT FOR HIGH TEMPERATURE HYDROCARBON PROCESSING

[75] Inventor: Louis M. Dvoracek, Brea, Calif.

[73] Assignee: Union Oil Company of California, Los Angeles, Calif.

[21] Appl. No.: 441,666

[22] Filed: Nov. 15, 1982

[51] Int. Cl.[3] ..... C10G 9/16

[52] U.S. Cl. ..... 208/48 AA; 252/49.8; 252/50

[58] Field of Search ..... 208/48 AA; 252/49.8, 252/50; 585/3

[56] References Cited

U.S. PATENT DOCUMENTS

| | | | |
|---|---|---|---|
| 2,167,867 | 8/1939 | Benning | 252/49.8 |
| 2,224,695 | 12/1940 | Prutten | 252/49.8 |
| 2,290,859 | 7/1942 | Burk et al. | 252/49.8 |
| 2,596,140 | 5/1952 | Gamrath et al. | 252/49.8 |
| 2,716,657 | 8/1955 | Bretschneider | 252/49.8 |
| 2,721,846 | 10/1955 | Lyons et al. | 252/49.8 |
| 2,994,408 | 8/1961 | Screm et al. | 252/49.8 |
| 3,017,357 | 1/1962 | Cyba | 252/32.5 |
| 3,261,774 | 7/1966 | Newkirk et al. | 208/48 |
| 3,342,909 | 9/1967 | Fenton | 252/49.8 |
| 3,403,102 | 9/1968 | Le Sever | 252/49.8 |
| 3,531,394 | 9/1970 | Koszman | 208/48 |
| 3,549,730 | 12/1970 | Abadir et al. | 252/49.8 |
| 3,645,886 | 2/1972 | Gillespie et al. | 208/48 AA |
| 3,647,677 | 3/1972 | Wolff et al. | 208/48 |
| 3,800,002 | 3/1974 | Chikatsu et al. | 208/48 AA |
| 3,926,823 | 12/1975 | Dirr et al. | 252/50 |
| 4,024,050 | 5/1977 | Shell et al. | 208/48 AA |
| 4,115,288 | 9/1978 | Schmitt | 252/50 |
| 4,197,210 | 4/1980 | Bridger | 252/50 |

FOREIGN PATENT DOCUMENTS

| | | | |
|---|---|---|---|
| 598752 | 5/1960 | Canada | 252/50 |
| 1355602 | 1/1963 | France | 252/50 |
| 985180 | 3/1965 | United Kingdom | 208/48 AA |

OTHER PUBLICATIONS

Lubricating Engineering, A Synthetic Lubricant for Hydraulic Fluid, Feb.–Mar. 1947, pp. 24–26.

*Primary Examiner*—Delbert E. Gantz
*Assistant Examiner*—Cynthia A. Prezlock
*Attorney, Agent, or Firm*—Alan H. Thompson; Gregory F. Wirzbicki; Dean Sandford

[57] ABSTRACT

Fouling of metallic surfaces contacted with hydrocarbon oils at elevated temperatures is reduced by combining with the oil foulant-inhibiting amounts of at least one tri-substituted phosphate.

22 Claims, No Drawings

ANTIFOULANT FOR HIGH TEMPERATURE HYDROCARBON PROCESSING

BACKGROUND OF THE INVENTION

1. Field of the Invention

The present invention relates to the reduction of fouling of hydrocarbon oil processing equipment. More particularly, the invention relates to an antifoulant additive composition, a hydrocarbon oil composition containing the antifoulant additive and a method of using this additive for reducing fouling in oil processing equipment.

2. Description of the Prior Art

In processing various hydrocarbon oils, such as crude petroleum, shale oils, syncrude oils, oils from bituminous sands, and fractions thereof, including napthas, middle distillate oils, gas oils, heavy vacuum gas oils, topped crudes, atmospheric or vacuum residual fractions, viscous pitches, and the like, it is usually necessary to heat the hydrocarbon oil to an elevated temperature by contacting it with a heated metal surface, e.g., by flowing it through a heating device such as a tube and shell heat exchanger or through the tubes of a direct-fired heater. Many hydrocarbon oils, however, tend to foul metal surfaces with which they come in contact at elevated temperatures by depositing thereon solid or semi-solid materials, commonly called foulants, such as inorganic salts, coke, tars, polymers, and other carbonaceous matter. Such fouling materially reduces the efficiency of heat transfer from the metal surface to the oil, thereby increasing the amount of fuel required to heat the oil to the desired temperature. It also reduces the hydraulic capacity of the heat exchange equipment (thereby increasing the amount of energy required to pass the oil through the equipment) and in aggravated cases may render it impossible to maintain the desired flow rate. Consequently, hydrocarbon oil processing units must be periodically shut down and deposits removed or the units replaced. Such fouling of heat exchangers, and also equipment such as furnaces, pipes, reboilers, condensers, compressors, auxiliary equipment, and the like, is costly due to the loss of production time and the man-hours required for disassembly, cleaning and reassembly of unit process equipment components. The equipment is usually fabricated of carbon steel, stainless steel, chrome-steels, steel alloys, aluminum or other metallic materials.

A variety of materials have thus far been added to hydrocarbon oils to produce compositions that reduce fouling of heated surfaces and consequently increase heat transfer efficiency. Unfortunately, none of the materials thus far developed are successful in completely eliminating fouling-related difficulties in hydrocarbon processing operations. Consequently, efforts are continuing to effect even greater improvement in such operations to minimize, or preferably completely eliminate, fouling of heated surfaces.

It is, therefore, an object of this invention to provide a hydrocarbon oil composition that has a reduced tendency for fouling.

It is also an object of this invention to provide a method for preparing a hydrocarbon oil composition that has a reduced tendency for fouling.

Another object in this invention is to provide a hydrocarbon oil composition containing an additive that reduces the energy requirements of hydrocarbon processing equipment.

Yet another object is to provide a method for increasing the heat transfer efficiency in hydrocarbon processing equipment.

Still another object is to reduce the energy requirements for heated surfaces in contact with a hydrocarbon oil composition containing an additive.

These and other objects and advantages of the invention will become apparent from the following description.

SUMMARY OF THE INVENTION

The present invention involves a hydrocarbon oil composition having a reduced tendency for fouling surfaces contacted by the oil at elevated temperatures. Such an oil composition contains a tri-substituted phosphate additive which typically is characterized by the formula:

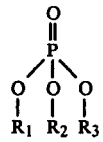

where $R_1$, $R_2$ and $R_3$ are selected from the group consisting of alkyl, aryl, alkaryl, cyloalkyl, alkenyl, and aralkyl radicals.

The invention further provides a method for reducing fouling of heated surfaces including the step of preparing a hydrocarbon oil composition containing an additive comprising at least one tri-substituted phosphate, preferably tridecyl phosphate. The method and composition can be employed with heat exchange equipment at relatively high temperatures. The method and composition have the advantage over known additives of utilizing lower concentrations of additive to obtain an acceptably low fouling rate as well as utilizing equivalent concentrations to obtain an improved fouling rate.

DETAILED DESCRIPTION OF THE INVENTION

The method and composition of the present invention may be applied with respect to any hydrocarbon oil which tends to foul metal surfaces which are contacted by the oil at an elevated temperature. In general, such hydrocarbon oils include petroleum crude oils, syncrude oils, shale oils, oils from bituminous sands and the like, and all other hydrocarbons which typically deposit foulants when heated to temperatures above about 250° F. The invention is particularly applicable with respect to those fractions of hydrocarbon oils in which at least about 50 weight percent of the oil normally boils above about 500° F., as for example, a diesel, gas oil, or a heavy vacuum gas oil. The invention is most often employed with those heavy oils in which at least 50 weight percent of the oil normally boils above about 850° F. such as atmospheric or vacuum residua and viscous pitches. The invention is employed particularly with feedstocks which characteristically deposit large amounts of foulants during distillation or other processing, such as those passing through furnaces and heaters of cokers, visbreaking units and crude oil units.

It is highly preferred that the hydrocarbon oil be substantially anhydrous. A "substantially anhydrous"

hydrocarbon as used herein refers to hydrocarbon oil compositions containing up to that amount of water soluble in the oil at atmospheric conditions. Ordinarily, the amount of water soluble in the hydrocarbon oil is less than 5, usually less than 1, and most usually less than 0.1 weight percent. In some cases, the processing of non-anhydrous hydrocarbon oil compositions in the invention detrimentally affects the rate of fouling, in that it is highly preferred that non-anhydrous hydrocarbon oils be pretreated for water removal, as by distillation or decantation means and the like.

According to the present invention, at least one tri-substituted phosphate compound is combined with the hydrocarbon oil, thus producing a composition having a reduced tendency for fouling at elevated temperatures. The tri-substituted phosphates used herein are tri-substituted esters of phosphoric acid wherein all three ionizable hydrogens are substituted with organic radicals. The tri-substituted phosphate is preferably soluble or dispersible in the hydrocarbon oil and is characterized by the formula:

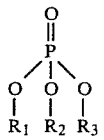

where $R_1$, $R_2$ and $R_3$ are selected from the group consisting of alkyl, aryl, alkaryl, cycloalkyl, alkenyl, and aralkyl radicals. In a given tri-substituted phosphate, $R_1$, $R_2$ and $R_3$ may be the same or different members of the above group. The tri-substituted phosphates may be conventionally prepared and many are available commercially. Typically, the tri-substituted phosphates contain from 6 to 15, and preferably 8 to 12, carbon atoms per radical. Representative of suitable tri-substituted phosphates include trihexyl phosphate, tricyclohexyl phosphate, triheptyl phosphate, trinonyl phosphate, tridecyl phosphate, trilauryl phosphate, tricetyl phosphate, trioctodecyl phosphate, triheptadecyl phosphate, triphenyl phosphate, trialpha or beta naphthyl phosphate, trialpha or beta naphthenyl phosphate, tribenzyl phosphate, tritolyl phosphate, dimethyl phenyl phosphate, diamyl phenyl phosphate, dinonyl phenyl phosphate, diphenyl nonyl phosphate, diisobutyl phenyl phosphate, tripolyisobutenyl phosphate, tripolyisobutylphenyl phosphate, tripolyisobutylphenyl phosphate, triethyl phosphate, and the like. The most preferred tri-substituted phosphate employed in the invention is tridecyl phosphate, which is marketed commercially, such as by Chemco Specialty Chemicals Company under the trademark Chemco TD-901.

Other chemical additives in combination with at least one tri-substituted phosphate may be utilized in the composition of the invention. For instance, oil-soluble derivatives of hydrazine compounds may be admixed with one or more tri-substituted phosphate and a hydrocarbon oil to produce a composition having a reduced tendency for fouling. Preferred hydrazine derivative compounds include a phenyl hydrazine, totutriazole, monomethyl hydrazine, propoxylated dimethyl pyrazole, ethoxylated dimethyl pyrazole, and those marketed by The Olin Corporation under the trademarks Oxypruf 6, Oxypruf 12, Oxypruf 20, Oxypruf E and Oxypruf P. As is well known, the aforementioned trade designations correspond to compositions set forth as follows:

Oxypruf 6 contains di(2-hydroxypropyl)-di(2-hydroxypropoxypropyl) hydrazine,

Oxypruf 12 contains tetra-(hydoxypropoxypropoxypropyl) hydrazine,

Oxypruf E contains ethoxylated dimethyl pyroyole,

Oxypruf P contains propoxylated dimethyl pyroyole, and

Oxypruf 20 contains tetra-(propoxypropoxypropoxy propoxyl hydroxypropyl) hydrazine.

The foulant-inhibiting amount of a tri-substituted phosphate combined with the hydrocarbon oil, whether dissolved alone or in combination with other tri-substituted phosphates or other additive chemicals, will depend upon the degree to which the oil tends to deposit foulants at the temperature to which it is heated. At elevated temperatures, such as greater than 250° F., the hydrocarbon oil composition contacting a heated surface will typically exhibit a reduced rate of fouling when containing a foulant-inhibiting amount of at least one tri-substituted phosphate, usually about 1 ppmw to about 5,000 ppmw, preferably from about 5 ppmw to about 500 ppmw, and more preferably about 10 ppmw to about 400 ppmw. Fouling of heated surfaces maybe reduced when as little as 5 to 50 ppmw of tri-substituted phosphate is dissolved in heavy hydrocarbon oils having been heated to temperatures between about 400° F. and 1,200° F. as a result of being contacted with surfaces heated to temperatures from about 600° F. to about 1,500° F. However, heavy oils with a tri-substituted phosphate content above about 100 ppmw exhibit substantially reduced fouling.

In the presence or absence of an antifoulant additive, a particular hydrocarbon oil typically begins fouling a metallic surface when heated above a threshold temperature, which herein is termed the "incipient fouling temperature." At this temperature and higher, fouling of heated surfaces will occur and is manifested by a weight increase on the surfaces due to deposition of foulant materials. Although the invention is not to be held to any particular theory of operation, it is believed that the results obtained in the invention are at least in part due to compositions of the invention depositing foulant materials of better heat transfer characteristics than foulant materials from the same hydrocarbon oils but not containing the additive of the invention.

Ordinarily the invention is employed with a hydrocarbon oil having an incipient fouling temperature above about 250° F., preferably above about 500° F. and more preferably, above about 850° F. When in contact with a heated surface at the incipient fouling temperature, a hydrocarbon oil containing a tri-substituted phosphate additive exhibits better heat transfer efficiency than one without an additive. For example, a residuum hydrocarbon oil or a naptha-containing oil, both containing a tri-substituted phosphate at their respective incipient fouling temperatures of 1,000° F. and 600° F., exhibit better heat transfer efficiencies in contact with a heated surface than their counterparts without an antifoulant additive.

Fouling may be measured by the heat transfer efficiency of a heated surface contacting the hydrocarbon oil at the incipient fouling temperature. During a given contacting time period, the oil-contacting surface will gradually become fouled, necessitating an increase in surface temperature with increased fouling to maintain the oil composition at a given temperature. The temperature increase requirement (TIR) value (calculated in °F. per given time period) of the oil-contacting surface represents the net increase in surface temperature over a given timeperiod to maintain the oil composition at a given temperature. A large TIR value is indicative of low heat transfer efficiency and substantial fouling of the heated surface. Whether a TIR value is considered large or small will depend upon acceptable fouling rates in a particular application. For instance, as little as a 1° F. improvement in TIR value may significantly reduce the operating energy requirements in refinery processing equipment, as for example, between about 2 and 4 million BTU's per day in a visbreaking unit processing 20,000 barrel per day.

Fouling of a heated metal surface is substantially reduced by employing the composition of the invention. TIR values associated with surfaces contacted with a composition of the invention containing a hydrocarbon oil and tri-substituted phosphate additive are substantially smaller under comparative conditions than that for the same hydrocarbon oil containing no antifoulant additive; consequently, comparative TIR ratios (TIR of oil plus additive/TIR of oil alone) indicate that fouling is substantially reduced, often by at least about 40 percent, preferably at least about 60 percent, and most preferably at least about 70 percent.

It has been discovered in the practice of the present invention that less fouling is observed with compositions of the invention than with comparable compositions containing the same hydrocarbon oil containing only known antifoulant additives. Also, considerably lower concentrations of additives comprising a tri-substituted phosphate than known additives are employed to reduce fouling. Substantially equivalent or less fouling is observed with concentrations of tri-substituted phosphate that are up to about 10 times, preferably up to 15 times, and most preferably up to 20 times less than concentrations of known additives. Consequently, lower concentrations of tri-substituted phosphate than that of known additives are employed to maintain a given rate of fouling, or in the alternative, an equivalent concentration of additives comprising tri-substituted phosphate to that of known additives results in a lower fouling rate.

In the method of the invention, an anti-foulant material containing a tri-substituted phosphate is dissolved in hydrocarbon oil to produce a composition having a reduced tendency for fouling at elevated temperatures. Typically, the antifoulant material is introduced into a hydrocarbon oil stream at a location in the processing scheme immediately ahead of the heat exchanged surface where reduced fouling is desired. The antifoulant material is admixed with the oil in any manner resulting in contact of the heated surface with the antifoulant-containing oil in proportions disclosed herein. The tri-substituted phosphate is often first dissolved in a liquid carrier material and subsequently added to the hydrocarbon oil. Such liquid carrier materials include solvents that are soluble in the particular hydrocarbon oil being treated. Light hydrocarbon-containing solvents and aromatic hydrocarbon-containing solvents are commonly employed as carriers. Examples of solvents include kerosene, toluene, xylene, benzene, decane, isooctane and pentane.

The invention is further illustrated by the following examples which are illustrations of specific modes of practicing the invention and are not intended as limiting the scope of the appended claims.

EXAMPLE I

Seven hydrocarbon oil compositions of the invention and five known compositions are prepared for testing by admixing different amounts of antifoulant additives with a residuum hydrocarbon fraction obtained from a feedstock to a commercial visbreaking petroleum processing unit.

Tridecyl phosphate [$(C_{10}H_{21})_3PO_4$] is dissolved in kerosene and added to each of seven one-liter samples of residuum fraction in sufficient concentration so as to produce final composition Nos. 1 through 7 according to Table I. Tridecyl phosphate is determined to be present in increasing concentrations in composition Nos. 1 through 4, respectively. In the preparation of composition Nos. 5 through 7, commercial antifoulant material, Tetra-(propoxypropoxypropoxy propoxyl hydroxypropyl) hydrazine, marketed by The Olin Corporation under the trademark Oxypruf 20, is also added to the residuum fraction in a concentration sufficient to produce compositions set forth in Table I.

In the preparation of three known compositions, Nos. 8 through 10, Oxypruf 20 is added to each of three one-liter samples of the residuum fraction in sufficient concentration to produce compositions set forth in TABLE I. Composition No. 8 contains a relatively high concentration of Oxypruf 20 as the only additive. Additionally a commercial antifoulant, marketed under the brand name of "Nalco IRC-706" (containing amine phosphates), is added to two one-liter samples of the residuum fraction containing Oxypruf 20 in a sufficient concentration to produce composition Nos. 9 and 10 set forth in TABLE I. Composition Nos. 11 and 12 are prepared from one-liter samples of the residuum fraction to which are added known antifoulant additives including a mono-octyl ester of phosphoric acid and a mono-cyclic ether ester of phosphoric acid, respectively, in concentrations set forth in TABLE I.

In the preparation of composition No. 13, 900 grams of the residuum fraction and 100 grams of water are combined. Tridecyl phosphate, dissolved in kerosene, is added to the resultant combination in a concentration sufficient to produce the hydrocarbon oil composition set forth in Table I.

EXAMPLE II

A commercial accelerated fouling test apparatus is utilized in this Example. The apparatus is the THERMAL FOULING TESTER, Model No. TFT212B marketed by Alcor, Inc. Such an apparatus comprises a fuel reservoir with a piston and seal to accommodate feedstock and effluent, a nitrogen pressurizing system, a variable speed pump to control flow of feedstock to the heater section, and a heater section which contains an electrically heated annular single tube heat exchanger through which the feedstock flows and is heated to test temperatures. A thermocouple measures the outlet temperature of the feedstock and actuates a temperature controller to maintain a constant outlet temperature of the feedstock. This action increases the interior tube surface temperature to maintain the proper amount of heat to be transferred to the feedstock. A thermocouple located inside the tube heat exchanger measures the temperature of the interior surface of the tube. The entire system is closed and pressurized with nitrogen to prevent the ingression of air, water, and other contaminants.

A control feedstock from Example I, containing no antifoulant additive, is preheated to about 150° F. and introduced into a stainless steel tube heat exchanger at 500 p.s.i.g. and at a rate of 3.3 ml/minute. As the feedstock travels through the tube heat exchanger, it is heated to progressively increasing temperatures ranging from about 150° F. to 850° F. The temperature of the feedstock leaving the tube heat exchanger is maintained at 850° F. for three hours. In order to maintain an output temperature of the feedstock at 850° F., control of the interior surface of the tube heat exchanger is initially at a temperature of at least 1,000° F. At this tube surface temperature, the feedstock degrades (i.e. fouls) as it passes through the tube forming particles which tend to adhere to the inside surface of the tube heat exchanger and thereby increase the weight of the tube. During the three hour test, the temperature of the interior surface of the tube exchanger is gradually increased, as required, above the initial 1,000° F. temperature in order to maintain the output feedstock temperature at 850° F. The temperature increase requirement over the three hour period (TIR) is 50° F.

In addition to the control feedstock, compositions, Nos. 1 through 13, from Example I are tested in a similar manner and the results summarized in TABLE I. The percent reduction in fouling is calculated from a ratio of TIR values of each composition as compared to the control.

TABLE I

| Composition No. | ANTIFOULANT CONCENTRATION, PPMW $(C_{10}H_{21})_3PO_4$ | Hydrazine Derivative (Oxypruf 20) | Amine Phosphates (Nalco IRC-706) | Mono-octyl Ester of Phosphoric Acid | Mono-cyclic Ether Ester of Phosphoric Acid | Water, Weight Percent | TIR °F. (of tube) | $\frac{\text{TIR °F. comp}}{\text{TIR °F. control}} \times 100$ Percent Reduction in Fouling |
|---|---|---|---|---|---|---|---|---|
| Control | — | — | — | — | — | — | 50 | — |
| 1 | 82 | — | — | — | — | — | 28 | 44 |
| 2 | 104 | — | — | — | — | — | 18 | 64 |
| 3 | 165 | — | — | — | — | — | 14 | 72 |
| 4 | 330 | — | — | — | — | — | 12 | 76 |
| 5 | 248 | 82 | — | — | — | — | 13 | 74 |
| 6 | 165 | 165 | — | — | — | — | 14 | 72 |
| 7 | 82 | 248 | — | — | — | — | 34 | 32 |
| 8 | — | 500 | — | — | — | — | 30 | 40 |
| 9 | — | 250 | 500 | — | — | — | 17 | 66 |
| 10 | — | 125 | 250 | — | — | — | 18 | 64 |
| 11 | — | — | — | 110 | — | — | 32 | 36 |
| 12 | — | — | — | — | 110 | — | 26 | 46 |
| 13 | 110 | — | — | — | — | 10 | 37 | 26 |

In view of the data in TABLE I, composition Nos. 1 through 7, all of which contain an additive of the invention, demonstrate a reduced tendency for fouling as compared to the control. As the concentration of tri-substituted phosphate increases in composition Nos. 1 through No. 4 from 82 ppmw to 330 ppmw, the percent reduction in fouling also increases.

The data also indicate that a composition containing a tri-substituted phosphate in a concentration of about 110 ppmw yields about a 70 percent reduction in fouling. Composition Nos. 5 and 6, containing the additive of the invention in combination with Oxypruf 20, and composition Nos. 3 and 4, all containing at least about 110 ppmw of the tri-substituted phosphate, exhibit a substantial effect on the reduction of fouling, i.e., at least about 70 percent relative to the control.

None of the known compositions, Nos. 8, 9, 10, 11 and 12, all containing other additives in a concentration of at least about 110 ppmw, demonstrate such a reduction in fouling. Even composition No. 2 of the invention containing only 104 ppmw of the tri-substituted phosphate demonstrates dramatic reduction in fouling compared to compositions containing additives in higher concentrations found in composition Nos. 8, 11 and 12. Also, composition Nos. 9 and 10, containing greater than 7 and 3.5 times as much of known additives as composition No. 2, respectively, only show similar fouling reduction tendencies.

Composition No. 13, containing 110 ppmw of tridecyl phosphate and 10 weight percent of water in the residuum fraction, demonstrates a reduction in fouling compared to the control. However, the effect of water in the hydrocarbon oil composition apparently is detrimental to achieving substantially beneficial antifouling results.

Although particular embodiments of the invention have been described, it will be understood, of course, that the invention is not limited thereto since many obvious modifications can be made, and it is intended to include within this invention any such modifications as will fall within the scope of the appended claims.

I claim:

1. A substantially anhydrous hydrocarbon oil composition comprising a substantially anhydrous hydrocarbon oil having dissolved therein at least one tri-substituted phosphate in a concentration of about 5 ppmw to about 500 ppmw, said composition having a reduced tendency for fouling at elevated temperatures as compared to that of said anhydrous hydrocarbon oil.

2. The composition defined in claim 1 wherein said tri-substituted phosphate is characterized by the formula:

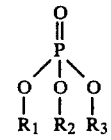

where $R_1$, $R_2$ and $R_3$ are selected from the group consisting of alkyl, aryl, alkaryl, cyloalkyl, alkenyl, and aralkyl radical.

3. The composition defined in claim 1 having better heat transfer characteristics at the incipient fouling temperature than said hydrocarbon oil without said tri-substituted phosphate.

4. The composition defined in claim 1 wherein said tri-substituted phosphate comprises tridecyl phosphate.

5. The composition defined in claim 1 wherein said hydrocarbon oil is one in which at least 50 percent boils at a temperature above about 500° F.

6. The composition defined in claim 1 further comprising at least one oil-soluble derivative of a hydrazine compound.

7. A substantially anhydrous hydrocarbon oil composition having a reduced tendency for fouling at elevated temperatures comprising a substantially anhydrous heavy hydrocarbon oil having dissolved therein a tridecyl phosphate compound.

8. The composition defined in claim 7 containing tridecyl phosphate in a proportion between about 5 ppmw and about 500 ppmw.

9. The composition defined in claim 7 having better heat transfer characteristics at the incipient fouling temperature than said heavy hydrocarbon oil without said tridecyl phosphate compound.

10. The composition defined in claim 7 wherein said heavy hydrocarbon oil is one in which at least 50 percent boils at a temperature above about 850° F.

11. The composition defined in claim 7 further comprising at least one oil-soluble derivative of a hydrazine compound selected from the group consisting of a phenyl hydrazine, totutriazole, monomethyl hydrazine, propoxylated pyrazole, ethoxylated dimethyl pyrazole, di(2-hydroxypropyl)-di(2-hydroxypropoxypropyl) hydrazine, tetra-(hydoxypropoxypropoxypropyl) hydrazine, ethoxylated dimethyl pyroyole, propoxylated dimethyl pyroyole, and tetra-(propoxypropoxypropoxy propoxyl hydroxypropyl) hydrazine.

12. A method for reducing fouling of heated surfaces contacted with a hydrocarbon oil during refinery processing thereof, said method comprising the step of contacting a substantially anhydrous hydrocarbon oil with said heated surfaces during said refinery processing, said substantially anhydrous hydrocarbon oil containing a foulant-inhibiting amount in a concentration of about 5 ppmw to about 500 ppmw, of an additive comprising at least one tri-substituted phosphate, said tri-substituted phosphate being characterized by the formula:

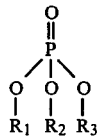

where $R_1$, $R_2$ and $R_3$ are selected from the group consisting of an alkyl, aryl, alkaryl, cyloalkyl, alkenyl, and aralkyl radical.

13. The method defined in claim 12 wherein said additive comprises an oil-soluble tri-substituted phosphate.

14. The method defined in claim 12 wherein the resultant hydrocarbon oil containing said tri-substituted phosphate has better heat transfer characteristics at the incipient fouling temperature than said hydrocarbon oil without said tri-substituted phosphate.

15. The method defined in claim 12 wherein said additive comprises tridecyl phosphate.

16. The method defined in claim 12 wherein said hydrocarbon oil is one in which at least 50 percent boils at a temperature above about 500° F.

17. The method defined in claim 12 wherein said additive comprises a mixture of said tri-substituted phosphate and one or more oil-soluble derivatives of hydrazine compounds.

18. A method for reducing fouling of surfaces contacted with a heavy hydrocarbon oil during refinery processing thereof, said method comprising the step of contacting a substantially anhydrous heavy hydrocarbon oil with said surfaces during said refinery processing, said substantially anhydrous heavy hydrocarbon oil containing a foulant-inhibiting amount of an additive comprising at least one tridecyl phosphate compound.

19. The method defined in claim 18 wherein said heavy hydrocarbon oil is one in which at least about 50 percent boils at a temperature above about 850° F.

20. The method defined in claim 18 wherein the resultant admixture has better heat transfer characteristics at the incipient fouling temperature than said heavy hydrocarbon oil without said tridecyl phosphate compound.

21. The method defined in claim 18 wherein said amount of additive is sufficient to provide said tridecyl phosphate in a concentration from about 5 ppmw to about 500 ppmw.

22. The method in claim 18 further comprising at least one oil-soluble derivative of a hydrazine compound selected from the group consisting of a phenyl hydrazine, totutriazole, monomethyl hydrazine, propoxylated pyrazole, ethoxylated dimethyl pyrazole, di(2-hydroxypropyl)-di(2-hydroxypropoxypropyl) hydrazine, tetra-(hydoxypropoxypropoxypropyl) hydrazine, ethoxylated dimethyl pyroyole, propoxylated dimethyl pyroyole, and tetra-(propoxypropoxypropoxy propoxyl hydroxypropyl) hydrazine.

* * * * *